US006500044B1

(12) United States Patent
Sasuga et al.

(10) Patent No.: US 6,500,044 B1
(45) Date of Patent: Dec. 31, 2002

(54) RUNNING TOY

(75) Inventors: Tadashi Sasuga, Tokyo (JP); Shigeru Kanauchi, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 10/160,013

(22) Filed: Jun. 4, 2002

(30) Foreign Application Priority Data

Jun. 11, 2001 (JP) ..... 2001-175943

(51) Int. Cl.[7] ..... A63H 11/00; A63H 13/00
(52) U.S. Cl. ..... 446/354; 446/376
(58) Field of Search ..... 446/330, 352, 446/353, 354, 355, 358, 359, 376, 377, 97

(56) References Cited

U.S. PATENT DOCUMENTS 4,302,903 A * 12/1981 Pun ..... 185/33
5,695,382 A * 12/1997 Lin ..... 40/418
6,036,572 A * 3/2000 Sze ..... 446/177
6,416,380 B1 * 7/2002 Lin-wen ..... 446/330

* cited by examiner

*Primary Examiner*—Jacob K. Ackun
(74) *Attorney, Agent, or Firm*—Staas & Halsey LLP

(57) ABSTRACT

A running toy capable of running stably regardless of a state of a floor, a road or the like. The running toy comprises: right and left leg parts provided so as to rotate forward and backward on a first horizontal axis; right and left rotating members provided so as to rotate on a second horizontal axis; a motor for driving the rotating members, wherein the leg parts engage with the rotating members at eccentric positions respectively, phases at the eccentric positions are different from each other, and the leg parts rotate forward and backward according as the rotating members rotate; and right and left grips provided at soles of the leg parts respectively, so as to be projected from and retracted in the soles respectively, and so as to be projected from the soles when the leg parts rotate from forward positions to backward positions respectively.

8 Claims, 8 Drawing Sheets

RUNNING TOY

BACKGROUND OF THE INVENTION

1. Field of the Invention

The present invention relates to a running toy, and in particular to a running toy capable of running stably.

2. Description of Related Art

For example, as a running toy capable of walking on both feet, a toy is known that runs by continuously taking a movement of lifting and stretching out one leg in a state wherein a sole of a foot of the other leg contacts with a ground, and after lifting and stretching out the other leg in a state wherein a sole of a foot of the one leg contacts with the ground.

Further, as another running toy, a toy is known that runs by moving right and left legs forward and backward in a state wherein a portion of each of soles of feet always contacts with a ground.

Because the former running toy as described above lifts one leg when running, it is difficult that the running toy keeps a right and left balance when running, and runs stably.

On the other hand, because the latter running toy as described above slips on a slippery floor or road and does not move forward even if moving the right and left legs forward and backward, it is difficult that the running toy runs stably.

Further, because some of running toys according to an earlier development have structures so that a power source, a power transmitting mechanism and a movable part thereof cannot be changed, there is a case wherein it is difficult that the running toys run stably, according to a state of a floor or a road.

The above-described problems occur not only in a toy robot, but also in a general running toy which runs or walks.

SUMMARY OF THE INVENTION

The present invention was developed in order to solve the problems as mentioned above.

An object of the present invention is to provide a running toy capable of running stably regardless of a state of a floor, a road or the like.

In accordance with an aspect of the present invention, a running toy comprises: right and left leg parts which are provided so as to rotate forward and backward on a first horizontal axis; right and left rotating members which are provided so as to rotate on a second horizontal axis parallel to the first horizontal axis; a motor for driving the right and left rotating members, wherein the right and left leg parts engage with the right and left rotating members at eccentric positions of the rotating members corresponding to the leg parts respectively, phases at the eccentric positions of the right and left rotating members are different from each other, and the right and left leg parts rotate forward and backward according as the right and left rotating members rotate; and right and left grips which are provided at soles of the right and left leg parts respectively, so as to be projected from and retracted in the soles of the right and left leg parts respectively, and so as to be projected from the soles of the right and left leg parts when the right and left leg parts rotate from forward positions to backward positions respectively.

The right and left rotating members are not limited specially. Each of the right and left rotating members may be a rotating member at an eccentric position of which a pin is provided, or a rotating member such as a cam, a crank and so on. Further, in case a gear mechanism is provided at each of the right and left leg parts, each of the rotating members may be a gear.

According to the running toy of the aspect of the present invention, because the right and left grips are provided at the soles of the right and left leg parts respectively, so as to be projected from the soles when the right and left leg parts rotate from the forward positions to the backward positions respectively, the grips can kick a floor or a road. Consequently, it is possible to drive the running toy forward.

Preferably, the running toy of the aspect of the present invention, further comprises: right and left cams which rotate according as the right and left rotating members rotate respectively; and right and left slave parts which move according to the right and left cams provided at the right and left leg parts respectively; wherein the right and left grips are fixed at lower end portions of the right and left slave parts respectively.

The right and left slave parts are not limited specially. Each of the right and left slave parts may be a part which is provided at the leg part so as to slide upward and downward, or a link mechanism.

According to the above-described running toy, because the right and left grips are moved by the right and left cams respectively, it is possible to project and retract each of the grips smoothly.

Preferably, in the running toy as described above, peripheral surfaces of the right and left rotating members are cam surfaces of the right and left cams respectively.

According to the above-described running toy, the cam surfaces of the right and left cams are formed on the peripheral surfaces of the right and left rotating members respectively, it is possible to simplify the structure of the running toy more than a case the cam is separated from the rotating member and provided at the running toy.

Preferably, the running toy as described above, further comprises a plurality of pairs of right and left rotating members, wherein one of the pairs has right and left rotating members having different structures from those of right and left rotating members of another pair, and the pairs can be changed to one another.

The pairs of right and left rotating members are not limited specially. One of the pairs may have right and left rotating members having different eccentric amounts of positions at which pins engaging longitudinal holes formed in the leg parts are provided from those of right and left rotating members of another pair. Further, in case the peripheral surfaces of the right and left rotating members of each of the pairs are the cam surfaces of the right and left cams respectively, one of the pairs may have right and left rotating members having different radius vectors to the cam surfaces from those of right and left rotating members of another pair.

Preferably, the running toy of t he aspect of the present invention, further comprises: a plurality of upper body parts at each of which the motor is provided, which are formed in different shapes from one another, and which can be changed to one another; and a base part at which any one of the upper body parts is provided so as to be attached thereto and detached therefrom.

According to the above-described running toy, because the upper body parts can be changed to one another, it is possible to change the whole structure of the running toy.

Preferably, the running toy of the aspect of the present invention, further comprises: a plurality of upper body parts at which motors having different characteristics from one another are provided respectively, and which can be changed to one another; and a base part at which any one of the upper body parts is provided so as to be attached thereto and detached therefrom.

The characteristic of the motor is not limited specially. The characteristic of the motor may be a horsepower, a rotation number or the like.

According to the above-described running toy, because the upper body parts can be changed to one another, it is possible to change a horsepower or a running speed of the running toy.

In accordance with another aspect of the present invention, a running toy comprises: a plurality of upper body parts at which motors having different characteristics from one another are provided respectively; a base part at which any one of the upper body parts is provided so as to be attached thereto and detached therefrom, and at which a power transmitting mechanism is provided; and a running part which is provided at the base part; wherein any one of the upper body parts is provided at the base part so that one of the motors, which is provided at the one of the upper body parts is connected to the power transmitting mechanism, and the upper body parts can be changed to one another.

The running part is not limited specially. The running part may be wheels or leg parts.

According to the above-described running toy, because the upper body parts can be changed to one another, it is possible to change a horsepower or a running speed of the running toy.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

PREFERRED EMBODIMENT OF THE INVENTION

Hereinafter, a running toy according to an embodiment of the present invention will be explained with reference to FIGS. 1 to 8, in detail.

1. Structure of a Running Toy

Figure 1:
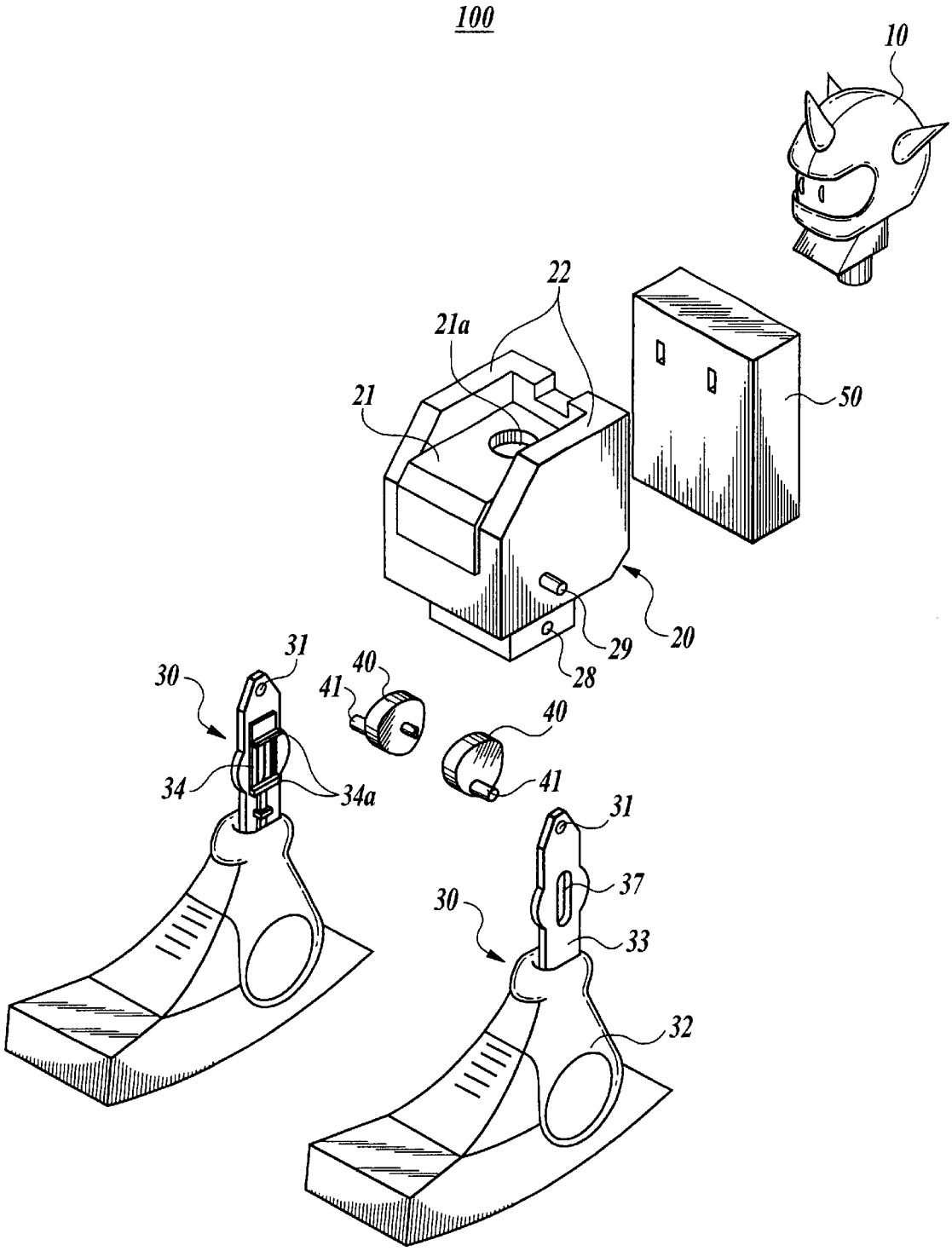
FIG. 1 is an exploded perspective view of a running toy according to an embodiment of the present invention.

FIG. 1 is an exploded perspective view of a running toy 100 according to an embodiment of the present invention. The running toy 100 mainly comprises an upper body part 10, a base part 20, leg parts 30, and a battery box 50.

2. Structure of the upper body part

The upper body part 10 simulates an upper half part of a body of a figure toy. As show in FIG. 2, a motor 11 is provided in an interior of the upper body part 10, and a small diameter gear (a pinion gear) 12 is fixed at a motor shaft 11*a* of the motor 11. The small diameter gear 12 is fixed at the motor shaft 11*a*, so as to be projected downward from a lower surface of the upper body part 10. The running toy 100 according to the embodiment, comprises a plurality of types of upper body parts such as upper body parts 10-1, 10-2 and 10-3 shown in FIG. 3. The upper body parts 10-1, 10-2 and 10-3 are formed in different shapes from one another, and have motors horsepower or rotation numbers of which are different from one another.

3. Structure of the Base Part

The base part 20 simulates a cockpit. As shown in FIG. 1, a seat portion 21 is provided at the base part 20 so that the upper body part 10 sits on the seat portion 21. A hole 21*a* is formed at the seat portion 21, so that the small diameter gear 12 is inserted in the base part 20 through the hole 21*a* when the upper body part 10 sits on the seat portion 21. Arm portions 22 are provided at both sides of the base part 20, so that the upper body part 10 is held between the arm portions 22 and fixed to the base part 20.

Figure 2:
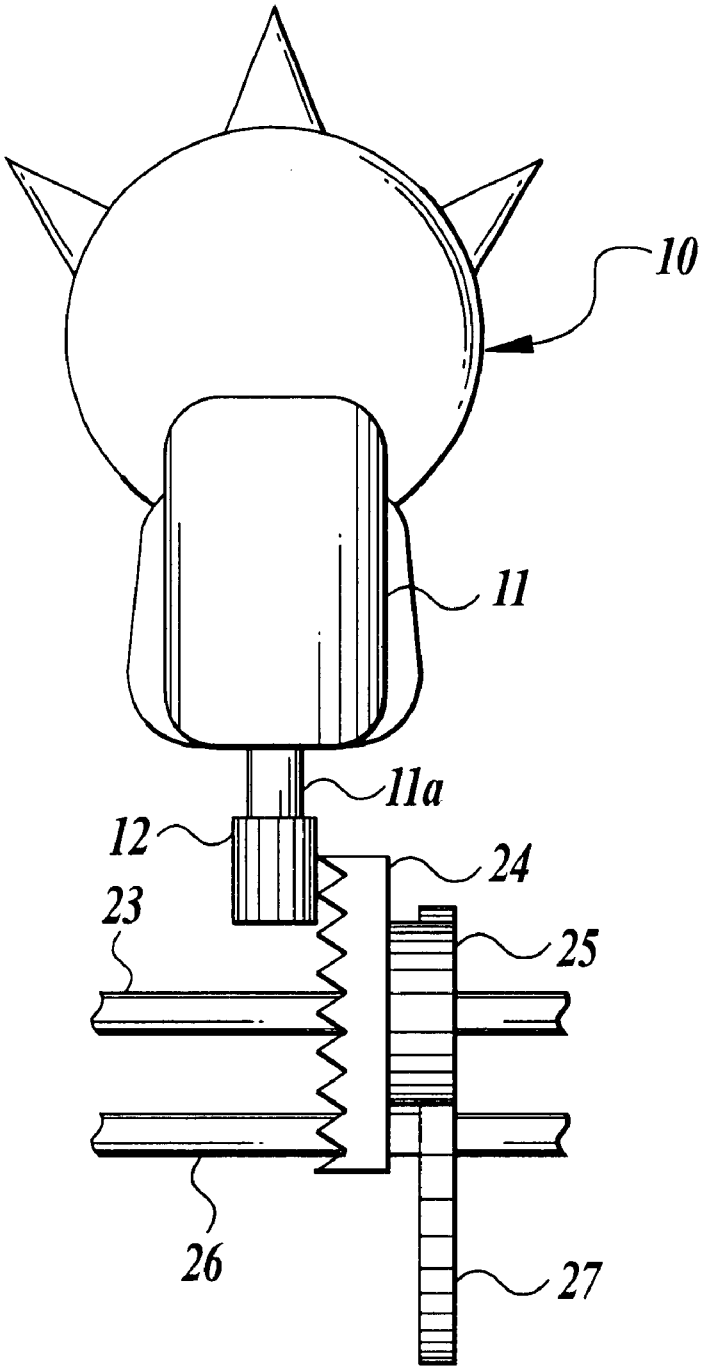
FIG. 2 is a view showing a power transmitting mechanism of the running toy shown in FIG. 1.
Figure 3A:
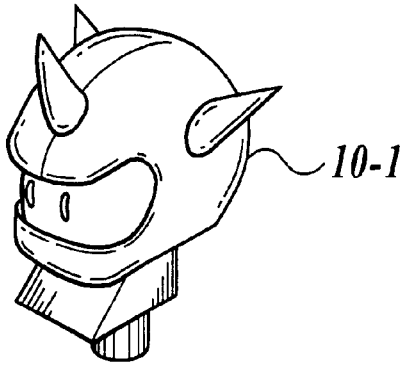
FIGS. 3A, 3B and 3C are views showing three types of upper body parts of the running toy shown in FIG. 1.
Figure 3B:
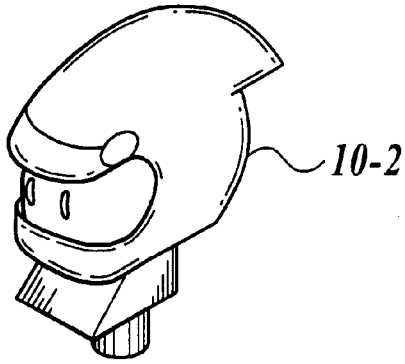
Figure 3C:
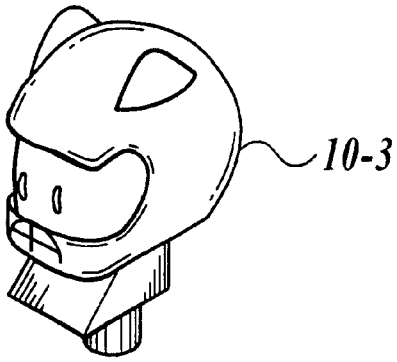

As shown in FIG. 2, a power transmitting mechanism is provided in an interior of the base part 20. A crown gear 24 fixed at a shaft 23 is provided at a position at which the crown gear 24 gears with the small diameter gear 12 inserted in the base part 20 through the hole 21*a*, in an interior of the base part 20. A small diameter gear 25 is fixed at the crown gear 24 as one. The small diameter gear 25 gears with a large diameter gear 27 fixed at a shaft 26 parallel to the shaft 23.

Figure 4:
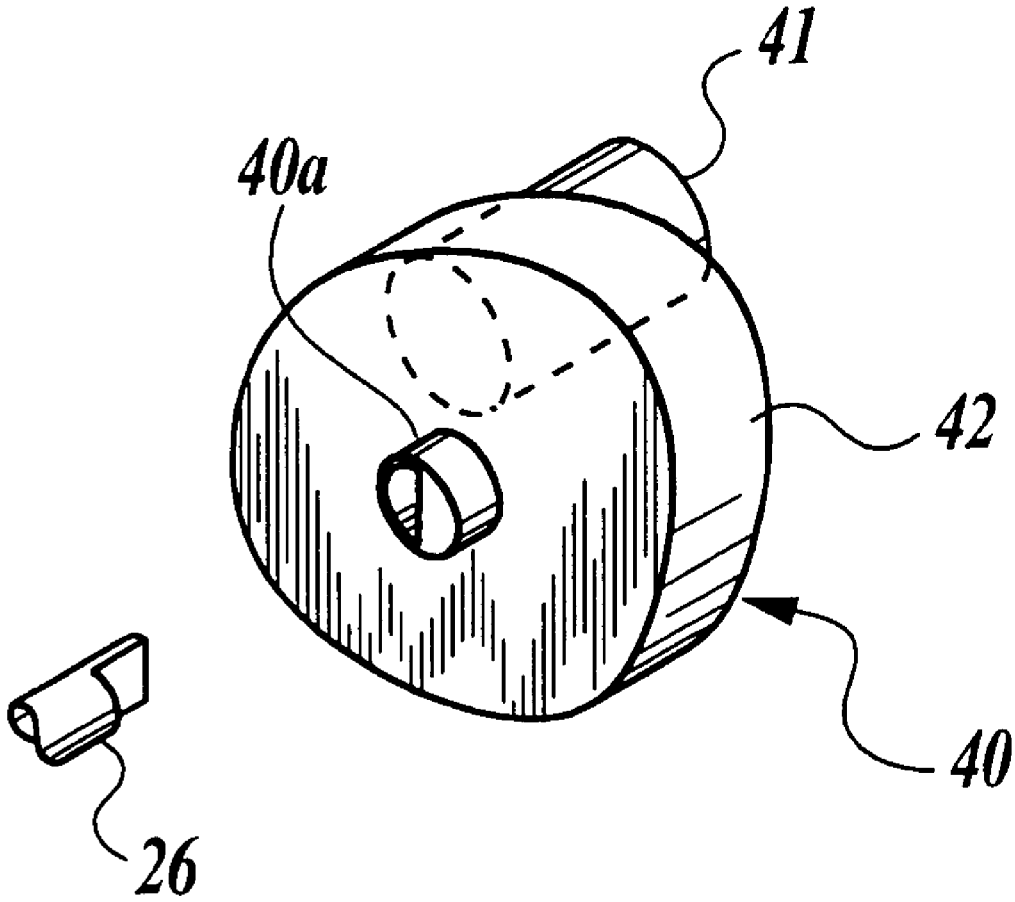
FIG. 4 is a view showing an attachment structure of a rotating member of the running toy shown in FIG. 1.

Rotating members 40 are provided at both sides of the base part 20, so as to be attached to and detached from the base part 20. That is, as shown in FIG. 4, the rotating member 40 comprises a cylindrical shaft portion 40*a*. On the other hand, as shown in FIG. 1, holes 28 are formed at positions to which the shaft 26 is extended, on both side surfaces of the base part 20, so that the shafts portions 40*a* of two rotating members 40 are inserted in the base part 20 through the holes 28 respectively. Therefore, when the shaft portions 40*a* are tightly fitted in both end portions of the shaft 26 through the holes 28 respectively so as to be attached to and detached from the shaft 26, the rotating members 40 are fixed at both sides of the base part 20.

A pin 41 is fixed at an eccentric position on an external surface of the rotating member 40. A peripheral surface of the rotating member 40 forms a cam surface 42, so as to be formed in a shape like an egg. That is, the rotating member 40 is also a circular disc cam.

As shown in FIG. 1, shafts 29 are provided at both side surfaces of the base part 20 respectively. The following leg parts 30 are attached to the shafts 29 respectively.

4. Structure of the Leg Part (1) Leg Part

As shown in FIG. 1, a hole 31 in which the shaft 29 is tightly fitted is formed at each leg part 30, so that the leg part 30 can rotate forward and backward on the shaft 29. A longitudinal hole 37 is formed at each leg part 30, so that the pin 41 of the rotating member 40 is fitted in the longitudinal hole 37. The leg part 30 comprises a foot portion 32, and a portion 33 including a thigh, a knee, a shin and so on, other than the foot portion 32. A sole of the foot portion 32 is formed in a convex surface which is expanded downward, so that the leg part 30 always keeps the state the sole contacts with the ground when rotates on the shaft 29 forward and backward. A slider 34 (slave unit) is attached to an inside of the leg part 30, so as to move upward and downward. A lower end portion of the slider 34 is inserted in the foot part 32. Contact portions 34*a* are provided at positions of the slider 34, so as to contact with upper and lower portions of the cam surface 42 of the rotating member 40 respectively. Because the contact portions 34*a* contact with the upper and lower portions of the cam surface 42, the slider 34 moves upward and downward according as the rotating member 40 rotates. A grip 35 is provide at a lower end portion of the slider 34, and formed in an inverse T wherein an upper portion is formed in a strip and a lower portion is expanded, shown in FIGS. 5A to 5D. The grip 35 is made of a material such as a rubber and so on, so that the grip 35 is not slippery easily.

(2) Circular Disc Cam

Figure 6:
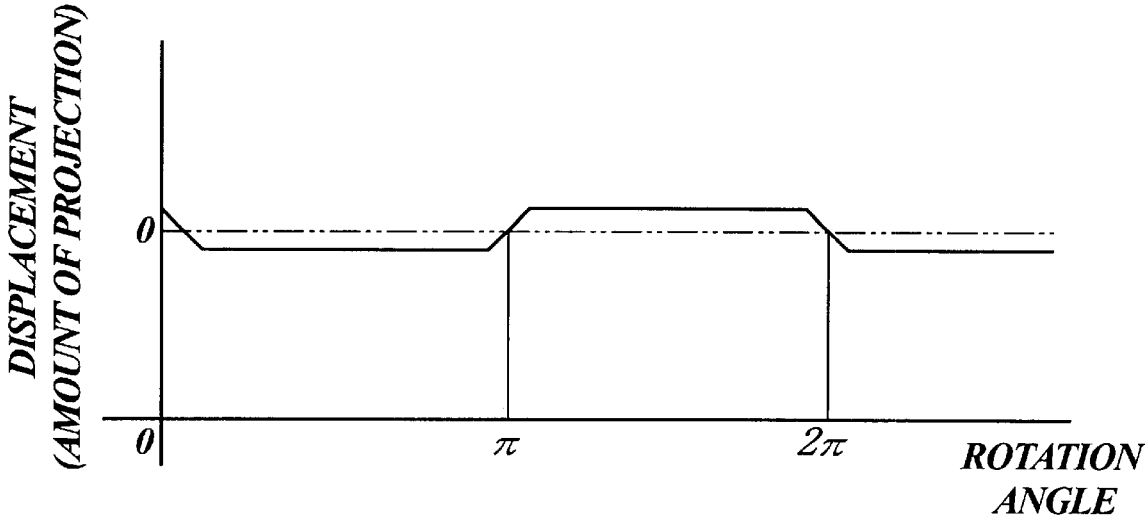
FIG. 6 is a cam diagram of the running toy shown in FIG. 1.

The rotating member 40 is a circular disc cam as described above. Although the rotating member 40 is not limited specially, a cam diagram of the rotating member 40 is shown in FIG. 6. In FIG. 6, the horizontal axis indicates a rotation angle of the rotating member 40, and the vertical axis indicates a displacement (amount of projection) of the slider 34. There is a phase difference of 180 degrees between the right and left rotating members 40.

Figure 5D:
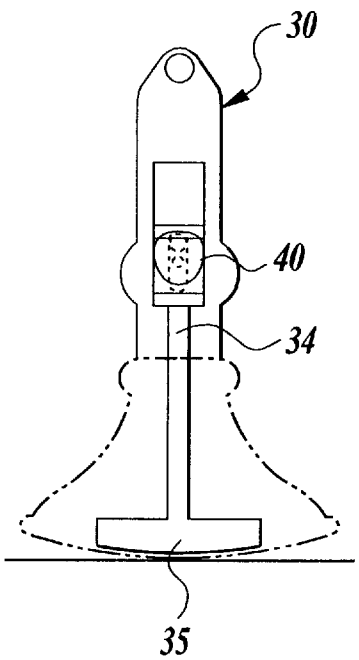
FIGS. 5A to 5D are views showing movements of a leg part and projection states of a grip of the running toy shown in FIG. 1.
Figure 5C:
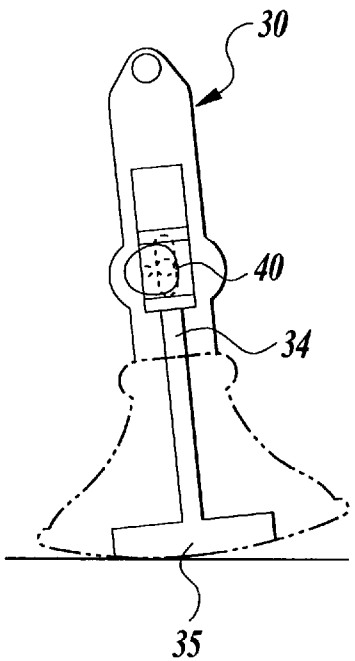
Figure 5B:
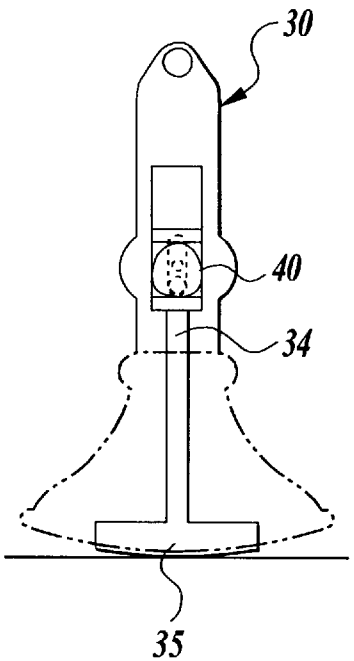
Figure 5A:
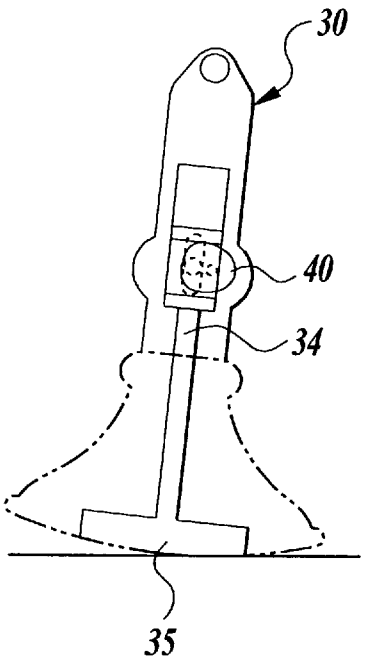

According to the circular disc cam, for example, when the leg part 30 is at the forward position according as the rotating member 40 is at the rotation angle of $\pi$ shown in FIG. 6, because the displacement of the slider 34 is 0, a lower surface of the grip 35 is one surface as the sole of the foot portion 32, as shown in FIG. 5A. When the leg part 30 rotates from the forward position to the backward position according as the rotating member 40 rotates backward from the rotation angle of $\pi$ to $2\pi$ shown in FIG. 6, because the slider 34 moves downward and is projected, the grip 35 is projected from the sole of the foot portion 32, as shown in FIG. 5B. When the leg part 30 is at the backward position according as the rotating member 40 is at the rotation angle of $2\pi$ shown in FIG. 6, because the displacement of the slider 34 is 0, the lower surface of the grip 35 is one surface as the sole of the foot portion 32, as shown in FIG. 5C. When the leg part 30 rotates from the backward position to the forward position according as the rotating member 40 rotates forward from the rotation angle of $2\pi$ shown in FIG. 6, because the slider 34 moves upward and is retracted, the grip 35 is retracted in the sole of the foot portion 32, as shown in FIG. 5D. In the case, the displacement of the slider 34 may be 0, and the lower surface of the grip 35 may be one surface as the sole of the foot portion 32, not shown in figures.

7. Structure of the Battery Box

As shown in FIG. 1, the battery box 50 is provided at the base part 20 so as to be attached to and detached from the base part 20. In order to provide the battery box 50 so as to attach to and detach from the base part 20, although the battery box 50 is not limited specially, the battery box 50 adopts a fitting type of attachment mechanism. Further, although the battery box 50 is not limited specially, the battery box 50 contains two AA size batteries not shown in figures, therein. Although the battery box 50 is not limited in the connection of the batteries contained therein to the motor 11, specially, the batteries is connected to the motor 11 through a pin, a conductive plate, or a conductor not shown in figures.

8. Accessory Part

Figure 7:
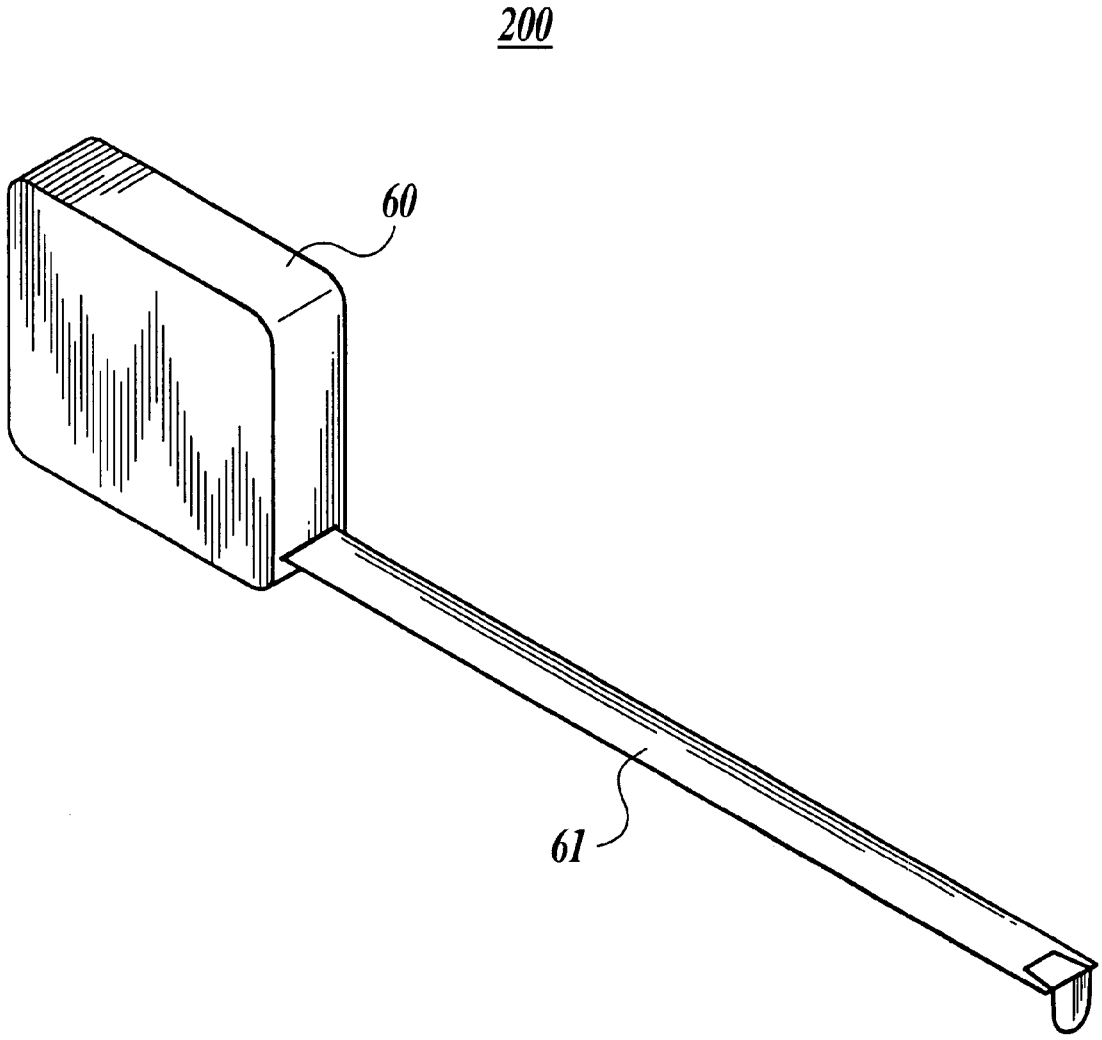
FIG. 7 is a view showing a course forming apparatus as an accessory part of the running toy shown in FIG. 1.

FIG. 7 is a view showing a course forming apparatus 200 for forming a course along which the running toy 100 runs. The course forming apparatus 200 is a tape measure type contained in a case, and comprises a case 60 and a tape 61 which can be pulled from the case 60. The tape 61 is rewound in the case 60, by an automatic pulling apparatus, according as a button of the case 60, not shown in figures is pushed, or by a manual apparatus, according as a handle of the case 60, not shown in figures is rotated. Preferably, the tape 61 is made of a bendable material so as to form an arbitrary course.

Figure 8:
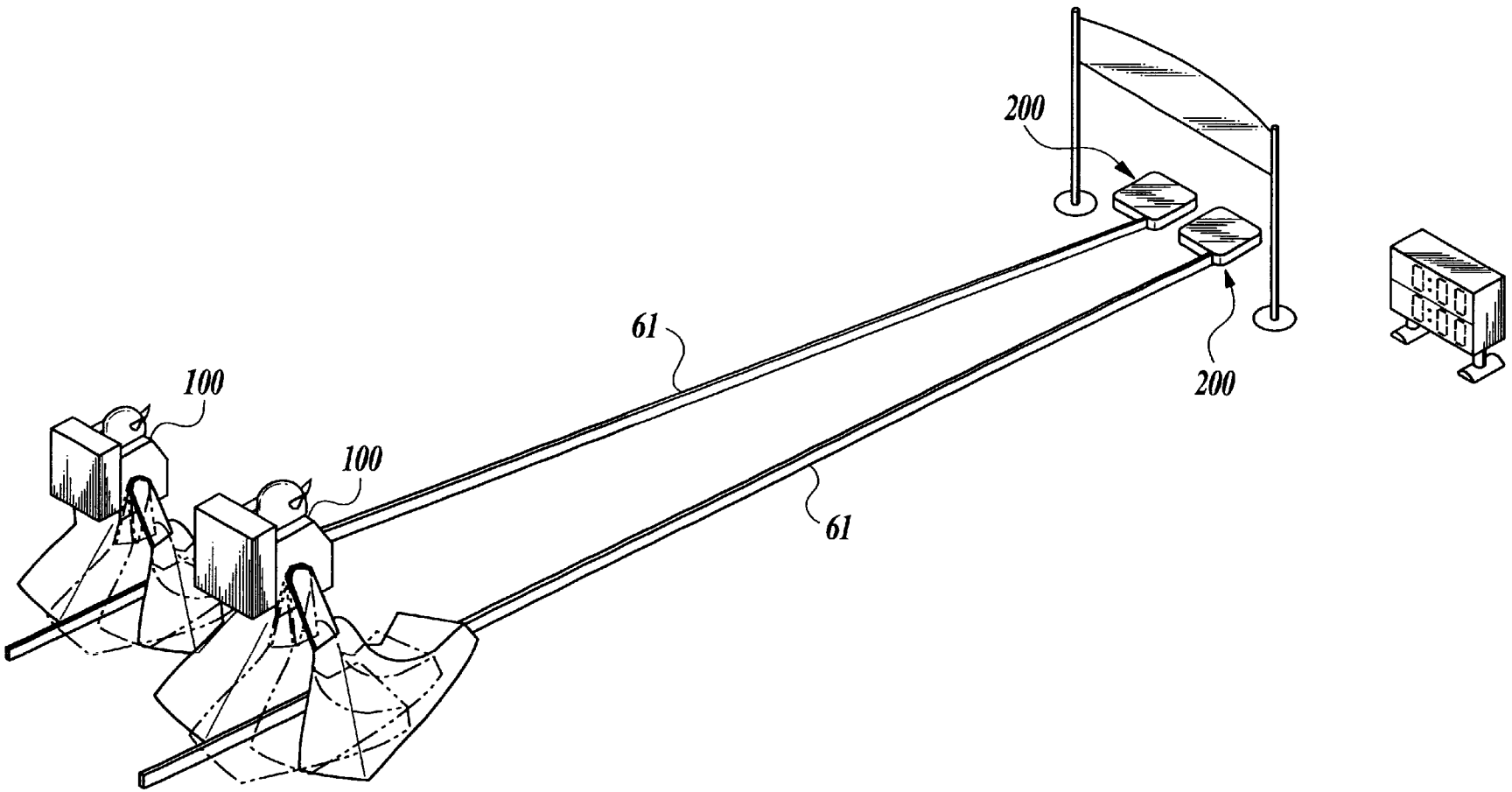
FIG. 8 is a view showing a state the course forming apparatus shown in FIG. 7 is used.

As shown in FIG. 8, the course forming apparatus 200 is provided, so that both surfaces of the tape 61 are tuned in the vertical direction, the tape 61 is provided between the right and left leg parts 30, and the tape 61 pulled from the case 60 is equipped so as to have an arbitrary shape.

9. Structure of Another Part

A power supply switch not shown in figures, is provided at any one of the upper body part 10, the base part 20 and the battery box 50.

10. Playing Method and Whole Movement (1) Playing Method

A player determines one upper body part 10 according to the floor, the road or the course, or the object of playing the running toy 100. Then, the player attaches the determined upper body part 10 to the base part 20. Thereafter, when the player brings the soles of the foot portions 32 of the running toy 100 into contact with the floor or the like, and tunes on the power supply switch, the player let the running toy 100 go. Accordingly, the running toy 100 runs forward. In case the player wants the running toy 100 to run along the course, as shown in FIG. 8, the player provides the tape 61 of the course forming apparatus 200, and disposes the tape 61 between the right and left leg parts 30 of the running toy 100.

(2) Whole Movement

When the power supply switch of the running toy 100 is tuned on, the motor 11 is driven. Then, when the right and left rotating members 40 rotate by the power of the motor 11, the right and left leg parts 30 move forward and backward. When the leg parts 30 move, the grips 35 are projected from and retracted in the soles of the foot portions 32 of the leg parts 30. Thereby, the running toy 100 runs forward.

11. Modifications of the Present Invention

Although the present invention has been explained according to the above-described embodiment, it should also be understood that the present invention is not limited to the embodiment and various changes and modifications may be made to the invention without departing from the gist thereof.

For example, a plurality of rotating members which have different shapes from one another and/or a plurality of leg parts lengths of which are different from one another may be provided for the running toy. In the case, the rotating members and/or the leg parts may be changed to one another, according to the state of the floor or the like. Further, the running toy may be remote controlled.

According to the present invention, an effect can be indicated, as follows.

As described above, the running toy comprises: right and left leg parts which are provided so as to rotate forward and backward on a first horizontal axis; right and left rotating members which are provided so as to rotate on a second horizontal axis parallel to the first horizontal axis; a motor for driving the right and left rotating members, wherein the right and left leg parts engage with the right and left rotating members at eccentric positions of the rotating members corresponding to the leg parts respectively, phases at the eccentric positions of the right and left rotating members are different from each other, and the right and left leg parts rotate forward and backward according as the right and left rotating members rotate; and right and left grips which are provided at soles of the right and left leg parts respectively, so as to be projected from and retracted in the soles of the right and left leg parts respectively, and so as to be projected from the soles of the right and left leg parts when the right and left leg parts rotate from forward positions and to backward positions respectively.

Accordingly, it is possible that the running toy runs stably regardless of the state of the floor, the road or the like.

The entire disclosure of Japanese Patent Application No. Tokugan 2001-175943 filed on Jun. 11, 2001 including specification, claims, drawings and summary are incorporated herein by reference in its entirety.

What is claimed is:

1. A running toy comprising:

right and left leg parts which are provided so as to rotate forward and backward on a first horizontal axis;

right and left rotating members which are provided so as to rotate on a second horizontal axis parallel to the first horizontal axis;

a motor for driving the right and left rotating members, wherein the right and left leg parts engage with the right and left rotating members at eccentric positions of the rotating members corresponding to the leg parts respectively, phases at the eccentric positions of the right and left rotating members are different from each other, and the right and left leg parts rotate forward and backward according as the right and left rotating members rotate; and right and left grips which are provided at soles of the right and left leg parts respectively, so as to be projected from and retracted in the soles of the right and left leg parts respectively, and so as to be projected from the soles of the right and left leg parts when the right and left leg parts rotate from forward positions to backward positions respectively.

2. The running toy as claimed in claim 1, further comprising:

right and left cams which rotate according as the right and left rotating members rotate respectively; and right and left slave parts which move according to the right and left cams provided at the right and left leg parts respectively;

wherein the right and left grips are fixed at lower end portions of the right and left slave parts respectively.

3. The running toy as claimed in claim 2, wherein peripheral surfaces of the right and left rotating members are cam surfaces of the right and left cams respectively.

4. The running toy as claimed in claim 1, further comprising a plurality of pairs of right and left rotating members, wherein one of the pairs has right and left rotating members having different structures from those of right and left rotating members of another pair, and the pairs can be changed to one another.

5. The running toy as claimed in claim 3, further comprising a plurality of pairs of right and left rotating members, wherein one of the pairs has right and left rotating members having different structures from those of right and left rotating members of another pair, and the pairs can be changed to one another.

6. The running toy as claimed in claim 1, further comprising:

a plurality of upper body parts at each of which the motor is provided, which are formed in different shapes from one another, and which can be changed to one another; and a base part at which any one of the upper body parts is provided so as to be attached thereto and detached therefrom.

7. The running toy as claimed in claim 1, further comprising:

a plurality of upper body parts at which motors having different characteristics from one another are provided respectively, and which can be changed to one another; and a base part at which any one of the upper body parts is provided so as to be attached thereto and detached therefrom.

8. A running toy comprising:

a plurality of upper body parts at which motors having different characteristics from one another are provided respectively;

a base part at which any one of the upper body parts is provided so as to be attached thereto and detached therefrom, and at which a power transmitting mechanism is provided; and a running part which is provided at the base part;

wherein any one of the upper body parts is provided at the base part so that one of the motors, which is provided at the one of the upper body parts is connected to the power transmitting mechanism, and the upper body parts can be changed to one another.

* * * * *